US005928007A

United States Patent [19]

Lundbäck

[11] Patent Number: 5,928,007

[45] Date of Patent: Jul. 27, 1999

[54] DEVICE FOR GROUNDING FEED CABLES BETWEEN TRANSMITTERS OR RECEIVERS AND ANTENNAS

[75] Inventor: Hans Olof Lundbäck, Markaryd, Sweden

[73] Assignee: Teracom Components AB, Horby, Sweden

[21] Appl. No.: 08/952,430

[22] PCT Filed: May 17, 1996

[86] PCT No.: PCT/SE96/00650

§ 371 Date: Nov. 17, 1997

§ 102(e) Date: Nov. 17, 1997

[87] PCT Pub. No.: WO96/37008

PCT Pub. Date: Nov. 21, 1996

[51] Int. Cl.[6] ..... H01R 4/58

[52] U.S. Cl. ..... 439/92; 174/92; 174/50; 174/35 R

[58] Field of Search ..... 439/92, 95, 96, 439/97, 98, 101, 108; 174/92, 50, 35 R

[56] References Cited

U.S. PATENT DOCUMENTS

| | | | |
|---|---|---|---|
| D. 243,407 | 2/1977 | Mooney et al. . | |
| D. 339,792 | 9/1993 | Nardi et al. . | |
| 3,274,447 | 9/1966 | Nelson . | |
| 3,312,868 | 4/1967 | Vodicka | 361/119 |
| 3,493,670 | 2/1970 | Broadbalt et al. | 174/65 SS |
| 3,515,948 | 6/1970 | Gutshall . | |
| 3,614,298 | 10/1971 | Thompson et al. | 174/92 |
| 3,798,349 | 3/1974 | Thompson et al. | 174/92 |
| 3,808,353 | 4/1974 | Burtelson | 174/92 |
| 3,830,957 | 8/1974 | Oberdiear . | |
| 3,836,943 | 9/1974 | Horak | 439/394 |
| 4,189,198 | 2/1980 | Reichman | 439/100 |
| 4,960,964 | 10/1990 | Schnell et al. | 174/51 |
| 4,972,505 | 11/1990 | Isberg | 455/3.1 |
| 5,171,162 | 12/1992 | Kaufman . | |
| 5,286,211 | 2/1994 | McIntosh . | |
| 5,403,214 | 4/1995 | Tirrell | 439/825 |
| 5,850,056 | 12/1998 | Harwath | 174/40 CC |

*Primary Examiner*—Paula Bradley
*Assistant Examiner*—Cecelia Wright Brown
*Attorney, Agent, or Firm*—McCormick. Paulding & Huber

[57] ABSTRACT

The present invention relates to a device for grounding feed or supply cables between transmitters or receivers and antennas or aerials, whereby at least one connector, through an aperture in the outer sheath of the supply cable, is in contact with an exposed portion of an inner conductor of the supply cable for grounding the inner conductor through at least one ground wire cooperating with the connector. In order to obtain the grounding of the inner conductor with few members, to mount the grounding device quick and safe and to reinforce the supply cable at the spot weakened by the aperture, the connector is provided on a bracket which in cooperation with at least one other bracket engages the supply cable and is located thereon so that the connector is directed into the aperture and is in contact with the exposed portion of the inner conductor, whereby the bracket with the connector has sealing members which engage the outer sheath around the aperture therein when the bracket with the connector is located on the supply cable.

22 Claims, 4 Drawing Sheets

DEVICE FOR GROUNDING FEED CABLES BETWEEN TRANSMITTERS OR RECEIVERS AND ANTENNAS

The present invention relates to a device for grounding feed or supply cables between transmitters or receivers and antennas or aerials, preferably between radio or television transmitters or radio or television receivers and radio or television aerials, whereby at least one aperture is provided in an outer sheath of the supply cable for exposing an inner conductor in said supply cable and whereby at least one connector is in contact with the exposed portion of the inner conductor for grounding said inner conductor through at least one ground wire cooperating with the connector.

Supply cables are grounded to prevent lightning strokes in the aerial from causing damages in the transmitter or receiver. If e.g. the aerial is mounted on a high mast, the supply cable is grounded in the mast at about every fiftieth meter and also in the ground at the base of the mast.

The devices for grounding the supply cable however, have some drawbacks. This result in that it takes an annoyingly long time to mount the devices, it is difficult to obtain a satisfactory sealing at the grounding point and the supply cable is weakened through the apertures therein.

The object of the present invention has primarily been to eliminate said drawbacks by means of a simple device. This is arrived at according to the invention by providing the abovementioned device substantially with the characterizing features of subsequent claim 1.

Since the device is provided with said characterizing features, grounding can occur by means of a few members, the mounting or assembly time is substantially reduced, a very good sealing is obtained around the aperture in the outer sheath and the weakened spot at said aperture in the outer sheath can be reinforced.

The invention will be further described below with reference to the accompanying drawings, wherein FIG. 1 schematically illustrates an aerial mast with a supply cable between the aerial and a transmitter or receiver, which supply cable is grounded at some locations with devices according to the invention;

FIG. 2 with a side view illustrates a portion of the supply cable of FIG. 1 provided with a device according to the invention of which one half is shown with a side view and the other half with a longitudinal section;

Figure 1:
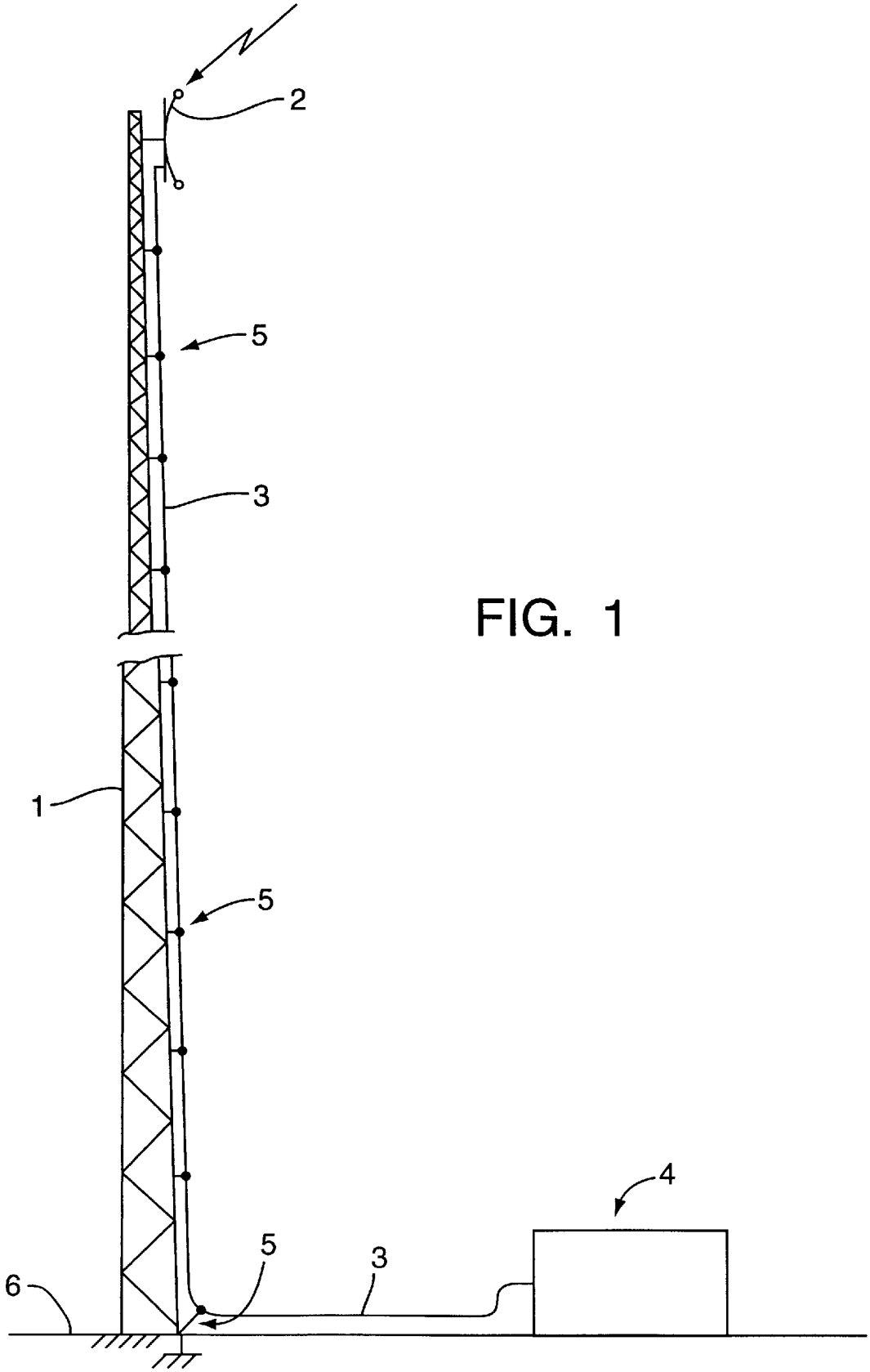
Figure 2:
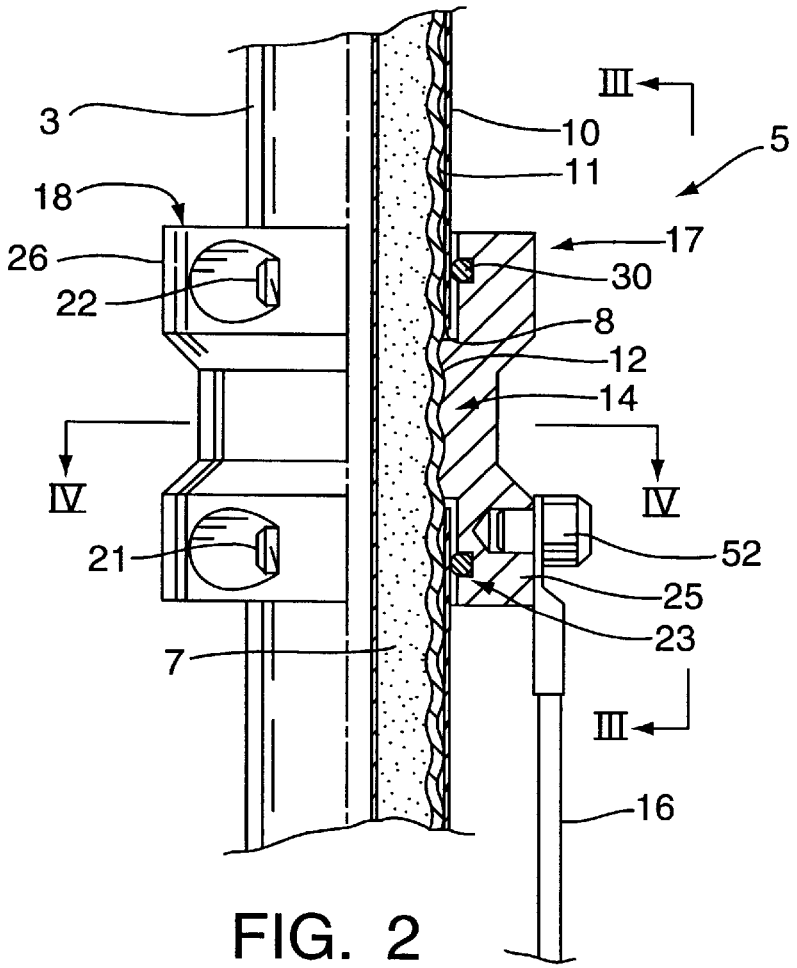
Figure 4:
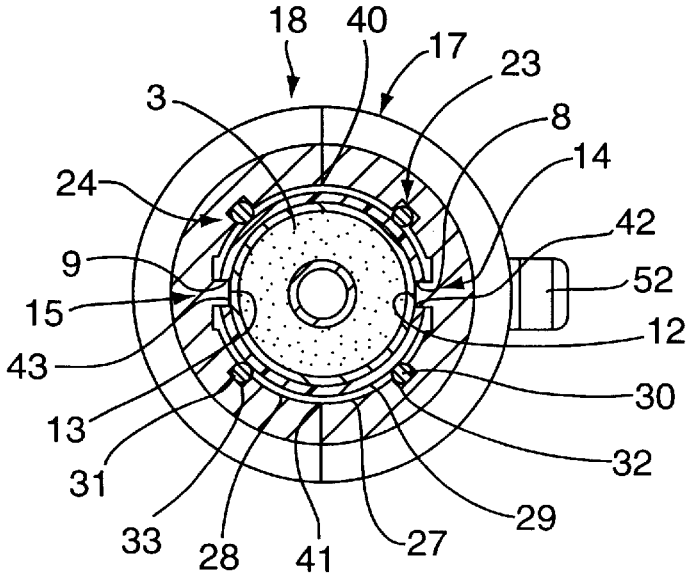
FIG. 4 is a section IV—IV through the device of FIG. 2.
Figure 3:
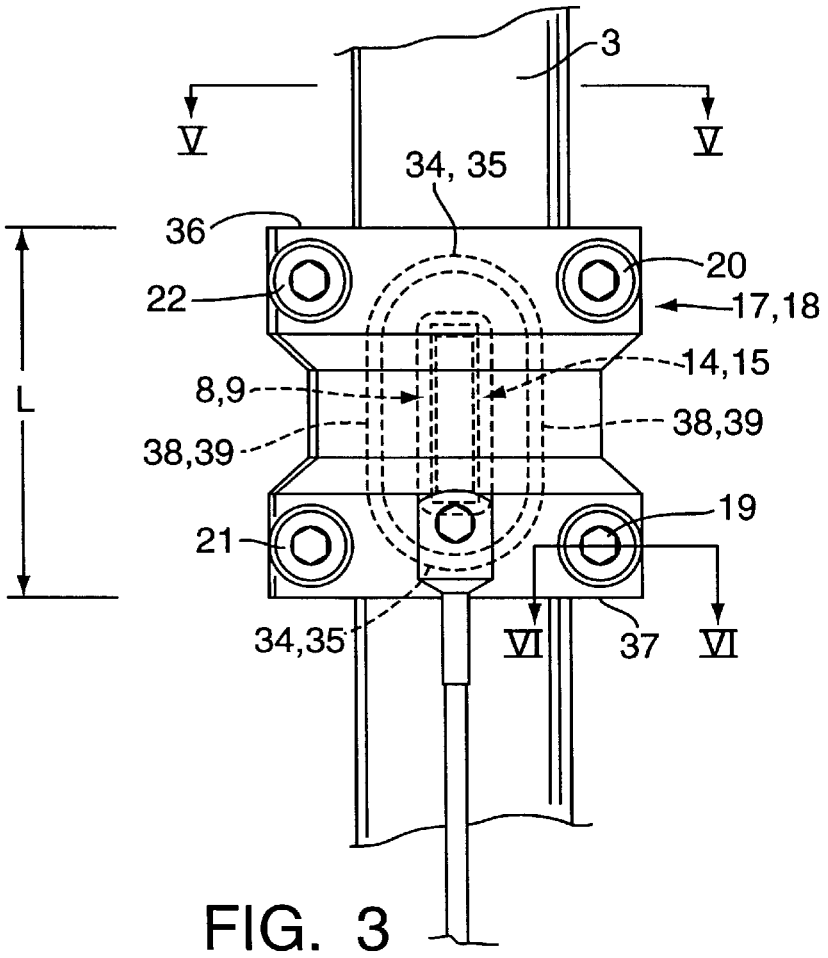
FIG. 3 is a view III—III of the device of FIG. 2.
Figure 5:
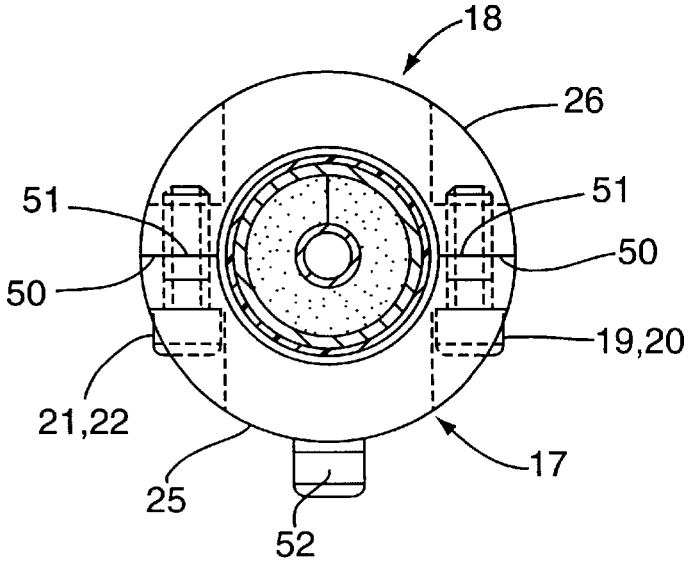
FIG. 5 is a section V—V through the supply cable of FIG. 3 and an end view of the device of FIG. 3.
Figure 7:
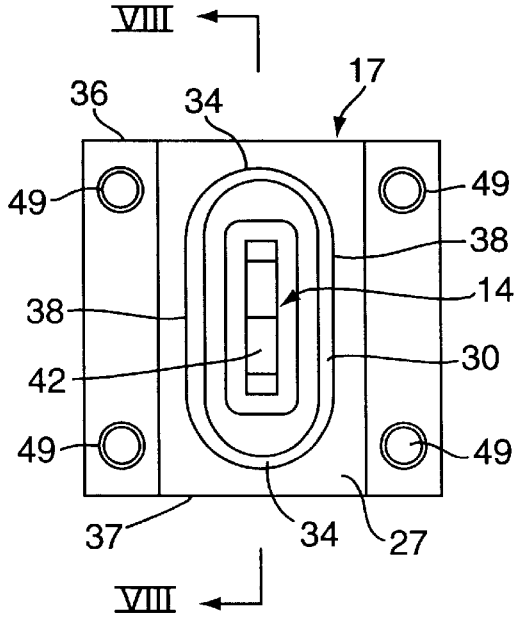
Figure 8:
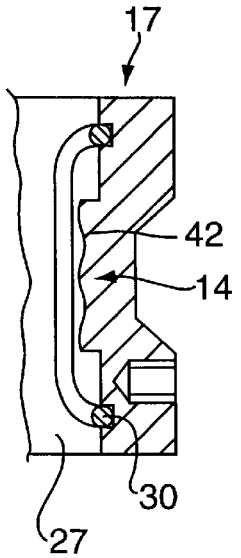

FIG. 7 with a plan view illustrates the inner side of a bracket forming part of the device of FIG. 1; and FIG. 8 is a section VIII—VIII through the bracket of FIG. 7.

In FIG. 1 a mast 1 having an aerial 2 and a feed or supply cable 3 mounted between said aerial 2 and a transmitter or receiver 4, is schematically illustrated. The aerial 2 can be a radio or television aerial and the transmitter or receiver 4 a radio or television transmitter or a radio or television receiver. In order to prevent damages on the transmitter or receiver 4 if the lightning strikes the aerial 2, the supply cable 3 is grounded at several locations, namely through grounding devices 5 which are schematically shown in FIG. 1. A number of such grounding devices ground or earth the supply cable 3 against the mast 1 and a grounding device 5 grounds the supply cable 3 preferably against the ground 6 at the base of the mast 1.

In order to locate the grounding devices 5 at certain parts 7 of the supply cable 3, two apertures 8, 9 are provided at each such part 7 in opposite portions of the outer sheath 10 of said supply cable 3. The apertures 8, 9 are made so that an inner conductor 11 provided in the supply cable 3 is partly exposed (portion 12). The inner conductor 11 has in the illustrated embodiment a circular cross-sectional form, it is corrugated in longitudinal section and it consists of conductive metallic material, preferably copper material.

The apertures 8, 9 can be made by a suitable appliance, e.g. by means of a punch pliers (not shown), which preferably can bring along the cut away pieces of the outer sheath 10 when the punch pliers is opened.

A connector 14 or 15 is connected with the respective exposed portion 12, 13 of the inner conductor 11, and cooperates with a ground wire 16. This ground wire 16 is joined to earth, which means that the inner conductor 11 is grounded or earthed at two opposite spots at each exposed portion 12.

Each connector 14, 15 is provided on a bracket 17 or 18, and these brackets 17, 18 are connected with each other by means of four tightening screws 19–22 or similar tightening or clamping means. These tightening screws permit release of one of the brackets from the other, whereafter said brackets 17, 18 can be placed opposite to each other on the part 7 of the supply cable 3 provided with the apertures 8, 9. Thereafter, the tightening screws 19–22 can once again be screwed into the released bracket and by tightening said tightening screws 19–22, said brackets 17, 18 can be brought to engage the supply cable 3 with pressure, whereby each connector 14, 15 is directed into the respective aperture 8, 9 and in contact with the respective exposed portion 12, 13 of the inner conductor 11.

Each bracket 17, 18 includes sealing members 23 and 24 respectively, which engage the outer sheath 10 around the respective aperture 8, 9 to prevent moisture and dirt and/or anything else from penetrating through said aperture 8, 9 and into the exposed portions 12, 13 of the inner conductor 11.

The length L of the brackets 17, 18 is selected so that they span over the apertures 8, 9 and engage the part 7 of the supply cable 3 on opposite sides of said apertures 8, 9 in such a way and/or with such a pressure that they reinforce and/or stiffen the supply cable 3 for opposing the weakening of said supply cable 3 caused by the provision of the apertures 8, 9.

At the embodiment illustrated in the drawings, each bracket 17, 18 is formed as a half tube member 25 and 26 respectively, which e.g. can have the shape of a half hollow cylinder or substantially a half hollow cylinder. Each half tube member 25, 26 has, in cross section, the shape of its inner side 27, 28 adapted or substantially adapted to the cross-sectional shape of the outer side 29 of the outer sheath 10 of the supply cable 3. In the embodiment shown, the tube members 25, 26 have, in cross section, semicircularly shaped inner sides 27 and 28 respectively, and the outer side 29 of the outer sheath 10 is, in cross section, circular or substantially circular.

Each sealing member 23, 24 consists of, in the embodiment shown, a sealing ring 30 or 31 of elastic material, preferably rubber material, which extends around the respective connector 14, 15. Each sealing ring 30, 31 is preferably placed in a groove 32 or 33, so that a portion thereof extends out of the groove 32. The sealing ring 30, 31 can be glued in the groove 32, 33 or retained therein in any other way.

Each groove 32, 33 is located so that two portions 34 or 35 of respective sealing ring 30, 31, extending at least partially in transverse direction relative to the respective half tube member 25, 26, are provided on opposite sides of the respective connector 14, 15, substantially between the connector 14, 15 and the end sides 36, 37 of said half tube member 25, 26. Furthermore, two longitudinal portions 38 or 39 of the respective sealing ring 30, 31 extending in the longitudinal direction of the respective half tube member 25, 26 are located on opposite sides of the respective connector 14, 15 and substantially between said connector 14, 15 and longitudinal edges 40, 41 of the inner side 27, 28 of the respective half tube member 25, 26. The longitudinal portions 38, 39 are linear or substantially linear and run in parallel with each other or substantially in parallel with each other, while the partially transverse portions 34, 35 are arcuate and connect the linear portions 38, 39 with each other.

Each connector 14, 15 is preferably elongated and extends in the longitudinal direction of the half tube member 25, 26 as well as of the inner conductor 11, and is preferably centrally or substantially centrally located in the respective half tube member 25, 26.

Each connector 14, 15 has a length and width which is only slightly less than the length and width of the aperture 8, 9 and is mounted on the inner side 27, 28 of the respective half tube member 25, 26 so that it protrudes into said respective aperture 8, 9. Each connector 14, 15 also has such a height that it with an end surface 42 and 43 respectively, engages the inner conductor 11. Since the inner conductor 11 in the illustrated embodiment is corrugated in the longitudinal direction thereof, the end surface 42, 43 of the respective connector 14, 15 is also corrugated in its longitudinal direction. Furthermore, the end surface 42, 43 preferably has the same arcuate shape in its transverse direction as the inner conductor 11.

Each connector 14, 15 preferably has a length which substantially corresponds with or is slightly less than half the length of the respective half tube member 25, 26 and preferably a width which substantially corresponds with 25% of the diameter of the inner side 27, 28 of the respective half tube member 25, 26.

Each connector 14, 15 and respective half tube member 25, 26 are preferably manufactured as a unit of the same conductive metallic material, whereby said unit preferably consists of brass with a silver-plated surface.

The tightening screws 19–22 are provided so that the half tube members 25, 26 can be easily disassembled or opened so that they quickly can be mounted on the supply cable 3 simply by positioning them on opposite sides thereof. Thereafter, the half tube members 25, 26 can be clamped around the supply cable 3 until their sealing rings 30, 31 with pressure engage the outer side of the outer sheath 10, while their connectors 14, 15 are in contact with the inner conductor 11.

Figure 6:
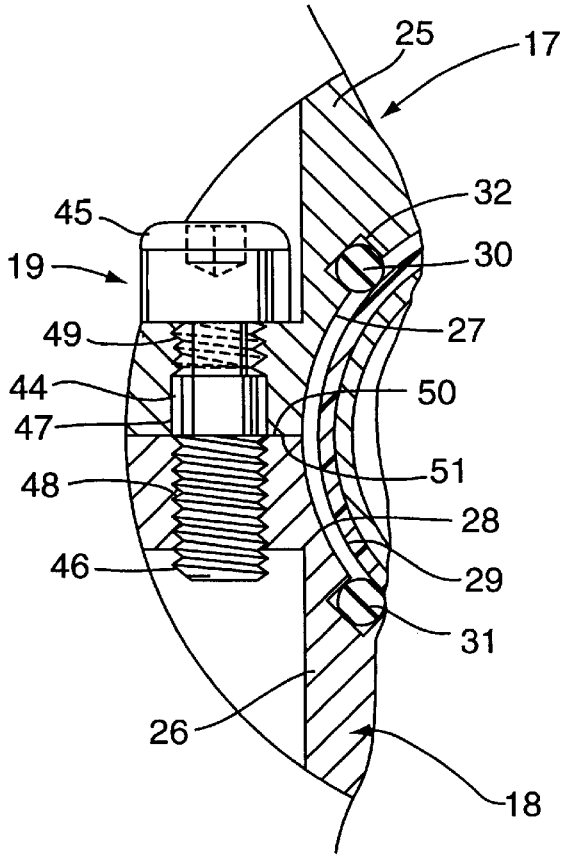
FIG. 6 is an enlarged section VI—VI through the device of FIG. 3.

Each tightening screw 19–22 preferably has an untapped inner portion 44 closest to the screw head 45 and an outer threaded portion 46 (see FIG. 6). The inner untapped portion 44 extends with play through the hole 47 therefor in e.g. one of the half tube members 25 and the threaded outer portion 46 is screwed into threads in the hole 48 therefor in the other half tube member 26.

The hole 47 in one of the half tube members 25 preferably has threads 49 along at least a part of its length (e.g. at the entrance of the hole 47), so that the tightening screw 19–22 does not loosen and fall down out of the tube member 25 when said screw is screwed out of the hole 48 in the other tube member 26.

Both the half tube members 25, 26 together encircle the part 7 of the supply cable 3 including the apertures 8, 9 and they can be clamped together by means of the tightening screws 19–22 so that they engage each other through opposing surfaces 50, 51. Hereby, contact is obtained between the half tube members 25, 26 so that their respective connector 14, 15 can be grounded with only one ground wire 16 which e.g. is connected with the half tube member 25. The ground wire 16 can be mounted on said half tube member 25 by means of a mounting or fixing screw 52 or another means of attachment.

Every half tube member 25, 26 can be shaped to surround half or substantially half the supply cable 3, the size and outer shape of both the half tube members 25, 26 are similar or substantially similar and the connectors 14, 15 have the same or substantially the same form and the same or substantially the same position on both the half tube members 25, 26.

The invention is not limited to what is described above and illustrated in the drawings, but may vary within the scope of the following claims. Thus, the invention can be used at feed or supply cables for other transmitters/receivers than television transmitters/receivers and radio transmitters/receivers. It is possible to use more than two brackets 17, 18 to hold one or more connectors 14, 15 in contact with the inner conductor 11; only one of several brackets 17, 18 may have a connector 14 or 15; there may be more than one connector 14, 15 on a bracket 17 or 18; the brackets 17, 18 may have other shapes than half tube members and/or hollow cylinders; the brackets 17, 18 do not need to have similar forms—one bracket may e.g. be shaped as a half tube and the other in another way; the brackets may entirely or partly be of conductive material; there may be another number than four tightening screws 19–22; there may be other clamping means than tightening screws 19–22; the sealing members 23, 24 may be of another type than sealing rings 30, 31; the sealing members may be located in other ways than shown; there may be more than one sealing member on every bracket 17 and 18 respectively; the tightening screws 19–22 may be of another type or other types of tightening or clamping means may be used.

I claim:

1. Device for grounding feed or supply cables between transmitters or receivers and antennas or aerials, preferably between radio or television transmitters or radio or television receivers and radio or television aerials, whereby at least one aperture is provided in an outer sheath of the supply cable for exposing an inner conductor in said supply cable and whereby at least one connector is in contact with the exposed portion of the inner conductor for grounding said inner conductor through at least one ground wire cooperating with the connector, characterized in that the connector is provided on a bracket which in cooperation with at least one other bracket engages the supply cable and is located thereon so that the connector is directed into the aperture and is in contact with the exposed portion of the inner conductor and that the bracket with the connector has sealing members which engage the outer sheath around the aperture therein when said bracket with the connector is located on the supply cable.

2. Device according to claim 1, characterized in that a length (L) of the brackets is selected so that said brackets span over the aperture and engage the outer sheath on opposite sides of said aperture in such a way and/or with such a pressure that they reinforce and/or stiffen the supply cable for opposing the weakening of said supply cable caused by the provision of the aperture.

3. Device according to claim 1, characterized in that the connector is elongated and extends in the longitudinal direction of the bracket as well as of the inner conductor.

4. Device according to claim 1, characterized in that the connector is located centered or substantially centered in relation to opposing end sides of the bracket, that the connector, in cross-sectional direction through the bracket, is centrally or substantially centrally located on an inner side of the bracket, which inner side, in said cross-sectional direction, is arcuate corresponding to or substantially corresponding to an outer cross-sectional shape of the supply cable, that the connector preferably has a length which corresponds to or is slightly less than half the length of the bracket and that the connector preferably has a width which corresponds to substantially 25% of a diameter of the arcuate inner side of the bracket.

5. Device according to claim 1, characterized in that the bracket and the connector consist of the same conductive metallic material and are manufactured in one piece, whereby said bracket and said connector preferably consist of brass with or without a silver-plated surface.

6. Device according to claim 1, characterized in that the bracket in its cross-sectional direction has an inner side, the shape of which is adapted to or substantially adapted to the outer side of the outer sheath of the supply cable in cross section, whereby the bracket in said cross-sectional direction has a semi-circular or substantially semicircular inner side, which is adapted to an in cross-sectional direction circular or substantially circular outer side of the outer sheath.

7. Device according to claim 1, characterized in that the sealing members comprise or consist of at least one sealing ring of elastic material, which sealing ring preferably is located in a groove in the inner side of the bracket, which groove runs around the connector.

8. Device according to claim 1, characterized in that both brackets have connectors which are in contact with different exposed portions of the inner conductor and that both connectors cooperate with one and the same ground wire for grounding both the exposed portions of the inner conductor.

9. Device according to claim 1, characterized in that the connector is located on an inner side of the bracket, that the connector has only a slightly smaller length and width than the aperture in the outer sheath and that the connector has such a height that it with an end surface engages the inner conductor.

10. Device according to claim 9, characterized in that the shape of the end surface of the connector is adapted to the shape of the inner conductor, whereby said end surface of said connector preferably has the same or substantially the same corrugation or wave form in its longitudinal direction as the inner conductor has in its transverse direction.

11. Device according to claim 1, characterized in that the sealing members of the bracket extend around the connector.

12. Device according to claim 11, characterized in that portions of the sealing members, extending at least partially in transverse direction relative to the longitudinal direction of the bracket, are provided substantially between the connector and end sides of said bracket, and that longitudinal portions of the sealing members, extending in the longitudinal direction of the bracket, are located substantially between the connector and longitudinal edges of the inner side of said bracket.

13. Device according to claim 11, characterized in that the longitudinal portions of the sealing members are linear or substantially linear and run in parallel or substantially in parallel with each other, and that the at least partially transverse portions of the sealing members are arcuate and connect the linear portions with each other.

14. Device according to claim 1, characterized in that the brackets are connected with each other by means of tightening screws, which permit disassembly or opening thereof for mounting on the supply cable, and that the tightening screws, by screwing in said screws, can tighten the brackets so that their sealing members with pressure engage the outer sheath of the supply cable.

15. Device according to claim 14, characterized in that each tightening screw has an uptapped inner portion closest to a screw head forming part of the tightening screw and an outer threaded portion, that the untapped inner portion is adapted to extend with play through a hole therefor in one of the brackets and that the threaded outer portion is adapted to be screwed into a threaded hole in the other bracket.

16. Device according to claim 15, characterized in that the hole in said one bracket, through which the untapped inner portion of the tightening screw is adapted to extend, has threads along at least a part of its length in order to prevent the tightening screw from loosening from said bracket when the threaded outer portion thereof is screwed out of the threaded hole in said other bracket when e.g. said brackets are disassembled or released from each other.

17. Device according to claim 1, characterized in that at least one of the brackets is formed as a half tube member or substantially as a half tube member.

18. Device according to claim 17, characterized in that both brackets are formed as half tube members or substantially as half tube members and that both said half tube members together encircles the part of the supply cable provided with the aperture.

19. Device according to claim 18, characterized in that each half tube member has a connector which through each one aperture in the outer sheath is in contact with opposite sides of the inner conductor, and that both the half tube members includes sealing members which engage the outer sheath of the supply cable around both apertures therein.

20. Device according to claim 18, characterized in that opposing surfaces of the half tube members engage each other to obtain contact therebetween, and that one of said half tube members includes a ground wire for grounding both half tube members contacting each other.

21. Device according to claim 18, characterized in that each of the half tube members surrounds half or substantially half the supply cable, that the size and outer shape of both half tube members are the same or substantially the same, that the connectors have the same or substantially the same shape and the same or substantially the same location on both said half tube members and that both said half tube members consist of conductive metallic material, preferably brass with silver-plated surface.

22. Device according to claim 18, characterized in that both the half tube members are shaped as half hollow cylinders or substantially as half hollow cylinders.

* * * * *